US006585197B1

(12) United States Patent
Daniels

(10) Patent No.: US 6,585,197 B1
(45) Date of Patent: Jul. 1, 2003

(54) PRODUCE BAGS AND DISPENSERS FOR SAME PROVIDING EASY OPEN FEATURES

(76) Inventor: Mark E. Daniels, 510 The Village, #307, Redondo Beach, CA (US) 90277

( * ) Notice: Subject to any disclaimer, the term of this patent is extended or adjusted under 35 U.S.C. 154(b) by 0 days.

(21) Appl. No.: 10/199,912

(22) Filed: Jul. 19, 2002

(51) Int. Cl.[7] ..... B65B 67/00; B65D 33/14

(52) U.S. Cl. ..... 248/97; 206/554; 383/9; 248/100

(58) Field of Search ..... 248/95, 99, 100, 248/97; 206/554; 383/8, 9; 211/85.15; D34/5, 6; 221/26

(56) References Cited

U.S. PATENT DOCUMENTS

| | | | | | |
|---|---|---|---|---|---|
| 23,873 | A | | 5/1859 | Treadwell | 40/495 |
| 216,438 | A | | 6/1879 | Morand | 126/212 |
| 302,062 | A | | 7/1884 | Van Choate | 137/445 |
| D68,871 | S | * | 11/1925 | Rice | D7/631 |
| 4,487,388 | A | | 12/1984 | Provan | 248/97 |
| 4,613,988 | A | * | 9/1986 | Maddock | 383/8 |
| 4,869,447 | A | | 9/1989 | Malik | 248/97 |
| 4,892,277 | A | * | 1/1990 | Tobis | 248/101 |
| 5,209,371 | A | | 5/1993 | Daniels | 221/63 |
| 5,213,145 | A | | 5/1993 | Huang et al. | 141/391 |
| 5,335,788 | A | | 8/1994 | Beasley et al. | 206/554 |
| 5,464,098 | A | | 11/1995 | Tseng et al. | 206/554 |
| 5,465,846 | A | | 11/1995 | Blyth et al. | 206/554 |
| RE35,207 | E | | 4/1996 | Daniels | 221/44 |
| 5,695,064 | A | | 12/1997 | Huang et al. | 252/512 |
| 5,732,833 | A | | 3/1998 | Alvarado et al. | 211/59.1 |
| 5,865,313 | A | * | 2/1999 | Huang et al. | 206/554 |
| 5,921,512 | A | | 7/1999 | Torres | 248/99 |
| 5,924,573 | A | | 7/1999 | Piraneo | 206/554 |
| 5,938,033 | A | | 8/1999 | Huang et al. | 206/554 |
| 5,979,841 | A | | 11/1999 | Piraneo et al. | 248/95 |
| 5,996,801 | A | | 12/1999 | Tsu | 206/554 |
| 6,070,388 | A | | 6/2000 | Zerlin et al. | 53/384.1 |
| 6,086,023 | A | | 7/2000 | Kerr et al. | 248/100 |
| 6,105,780 | A | | 8/2000 | Nguyen | 206/554 |
| 6,264,059 | B1 | | 7/2001 | Requena | 221/45 |
| 6,269,950 | B1 | | 8/2001 | Nguyen | 206/554 |
| 6,325,214 | B1 | | 12/2001 | Smithson | 206/554 |

* cited by examiner

*Primary Examiner*—Ramon O. Ramirez
*Assistant Examiner*—Jon Szumny

(57) ABSTRACT

A plastic bag and dispenser combination having a self-opening feature is described. The bag includes front and rear walls with tabs, first and second side edges, front and rear top edges, an openable mouth and sealed bottom edge. The dispenser has an upward pointing hanging means which fits through an opening in the tabs, and a positioning bar fixed horizontally at a first predetermined distance from the hanging means. When bags are suspended from the hanging means at the tabs and located over the positioning bar, they are ready for individual dispensing. The combination is also applied to T-shirt style bags. In a variant of the invention, bags are removably attached at the rear panel of a first bag to the front panel of a second bag. When the first bag is pulled from the dispenser, the rear panel pulls the front panel of the second bag forward, opening it.

19 Claims, 4 Drawing Sheets

Fig. 11
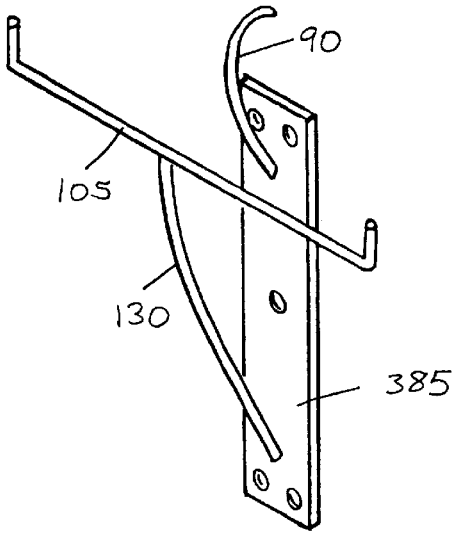
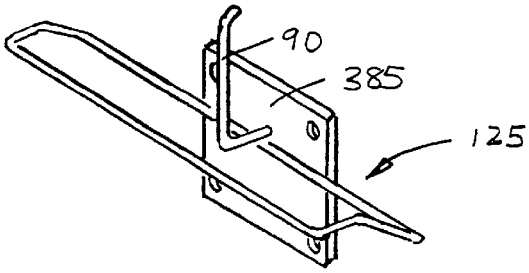
Fig. 10
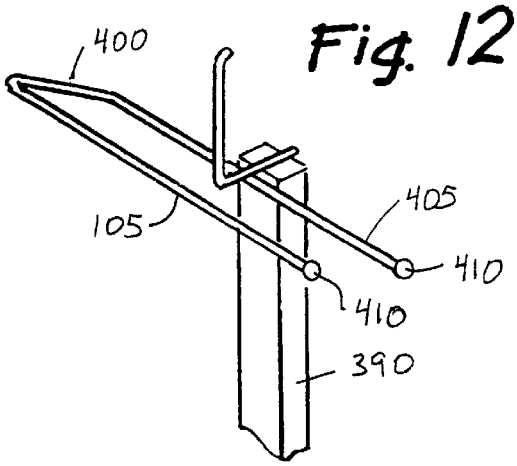
Fig. 12
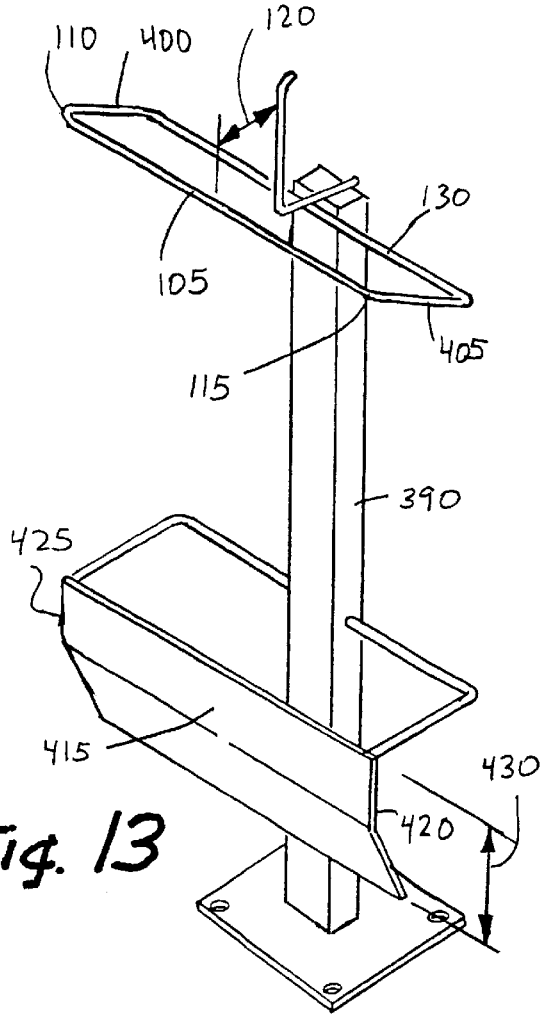
Fig. 13

PRODUCE BAGS AND DISPENSERS FOR SAME PROVIDING EASY OPEN FEATURES

FIELD OF THE INVENTION

The invention pertains to plastic produce bags and related dispensers. More particularly, the invention relates to expandable plastic film bags having integral carrying handles and central mounting tabs and dispensers for stacks of such.

BACKGROUND OF THE INVENTION

Various styles of produce bags and related dispensers are commonly.found in modern grocery stores and supermarkets. These bags are designed for customers to use when purchasing fresh produce. The bags currently available are difficult for customers to use for several reasons. First, the bags tend to cling together and are difficult to separate from the each other. Second, it is difficult to tell the open end of the bag from the closed end of the bag. Third, the bags are difficult to open, as the sides tend to cling together. When refilling a dispenser for produce bags mounted on rolls, the roll is optimally replaced when completely empty. However, this requires monitoring bag usage so as not to be replacing rolls when only partially used. A produce bag that identifies the proper end to open and provides features that allow the bag to be opened easily would save time and effort for produce purchasers.

Various methods and systems have been developed for opening plastic bags, incorporating a number of different technologies. U.S. Pat. No. 4,487,388 issued to Provan is directed to a holder for facilitating loading of plastic bags. The structure has a pair of spaced side members bent to provide a vertical rear portion as well as an arm portion. The structure also includes a forwardly protruding portion for insertion into the aperture of the stack of bags. In use, a bag is removed from the stack of bags and the handle loops and are placed on arm portion tabs, with the bottom of the bag resting on shelf When the bag is loaded, the handle loops are used to lift the bag and its contents from tabs.

U.S. Pat. No. 6,264,059 issued to Requena, is directed to an apparatus for dispensing plastic bags. This Patent is provided in that the embodiment seen in FIG. 3 is in some way similar to the present invention in that it includes a support hook 25 and a vertical elongate tubular member 22.

U.S. Pat. No. 5,465,846 issued to Blyth et al., discloses a bag dispensing system for use with a stack of plastic bags that are normally referred to as T-shirt style bags. The rack includes a pair of opposed side support rods and cantilevered from frame, as well as a support finger that is used to support the bag pack.

U.S. Pat. No. 5,209,371 issued to Daniels, the present inventor, describes a method and apparatus for dispensing T-shirt style merchandise bags. A rack is provided that is used to hold and dispense individual bags from a roll.

U.S. Pat. No. 6,070,388, issued to Zerlin et al. is directed to a bag opening system that is used for a series of bags in a stack. A wire bag holder comprising a base along with wire beams and as well as U-shaped catch that is used for holding the stack of bags.

U.S. Pat. No. 5,979,841, issued to Piraneo et al discloses a bag dispensing system for suspending and dispensing plastic bags such as T-shirt bags and merchandise bags comprises a bag dispenser constructed to be mounted underneath counters of checkouts. The bag dispensing system comprises relatively short bag engaging hooks that are inserted through apertures formed in T-shirt bags. The apertures are positioned to enable downward removal of the T-shirt bags from the bag dispenser by applying a small downward force. The bag dispensing system further comprises removably detachable bag supporting members to simultaneously support different sized merchandise bags. Merchandise bag engaging hooks provided on the bag dispenser, and slits formed through the merchandise bag panels and gussets, assist in the opening of the bags during dispensing.

U.S. Pat. No. 5,695,064, issued to Huang, et al. discloses a self-opening pack of plastic bags for use with a bagging rack. The pack of plastic bags is formed of plastic material that has been exposed to corona surface treatment. Each plastic bag in the pack of bags has a central tab portion between its two upwardly extending handles, which are at the sides of the mouth of the T-shirt bags. A central tab portion is located on the front and rear walls in the mouth region of the plastic bags. The central tab portion has a neck region and head region. The central tab portion has an aperture for receiving a retaining hook of a bagging rack, and a central tab slit which extends across the central tab portion, except for uncut portions near side edges of the central tab. The tearing cuts pass through the stack of bags and follow a non-straight path. Frangible pressure bonding is formed along the bottom edge of the central tab slit. When the top bag is removed from the bagging rack, the next bag in the pack of bags will self-open into a open position for loading with merchandise. Inverted "J"-shaped slits are formed in the handles for supporting the bag handles on the bagging rack.

While other variations exist, the above-described designs for dispensers for roll mounted bags are typical of those encountered in the prior art.

It is an objective of the present invention to provide a produce bag and dispenser combination that can be refilled at any time without waste of bags. It is another objective to provide a produce bag that readily identifies the openable end to the user. It is a further objective of the invention to provide a produce bag and dispenser combination that prevents the user from grasping multiple bags when using the dispenser. Finally, it is an objective of the invention to provide a system that opens the bags as they are removed from the dispenser.

While some of the objectives of the present invention are disclosed in the prior art, none of the inventions found include all of the requirements identified. The present invention addresses many of the deficiencies of prior art roll mounted bags and dispensers and satisfies all of the objectives described above.

SUMMARY OF THE INVENTION

A bag and dispenser combination providing the desired features may be constructed from the following components. A plurality of plastic bags is provided. Each of the bags has a front and rear wall, first and second parallel linear side edges, a first predetermined width, front and rear top edges, an openable mouth, a sealed bottom edge, the front and rear walls have front and rear tabs. The tabs are located at the top edges and have an opening therethrough. The opening is sized, shaped and positioned to provide means for hanging the bag.

The dispenser includes the following components. An upward pointing hanging means is provided. The hanging means has upper and lower ends and is sized and shaped to fit slidably through the opening in the tabs. A positioning bar is provided. The positioning bar has first and second ends and is positioned horizontally at a first predetermined distance from the hanging means. Means for supporting the hanging means are provided, as are means for supporting the positioning bar. When the bags are suspended from the hanging means at the tabs and located over the positioning bar, the bags will be positioned for individual dispensing.

In a variant of the invention, the bags are T-shirt style bags. Each bag includes a front panel and a rear panel. The front panel has first and second parallel linear side edges, a top edge and a bottom edge. The rear panel also has first and second parallel linear side edges, a top edge and a bottom edge.

Two front gusset panels are provided. The front gusset panels are of a first predetermined dimension. Each front gusset panel has a top edge, a bottom edge, first and second parallel side edges, and is joined at the first side edge to one of the linear side edges of the front panel. The gusset panels extend from the top edge of the front panel to the bottom edge thereof.

Two rear gusset panels are provided. The rear gusset panels are of a first predetermined dimension. Each rear gusset panel has a top edge, a bottom edge, first and second parallel side edges, and is joined at the first side edge to one of the linear side edges of the front panel. The gusset panels extend from the top edge of the rear panel to the bottom edge thereof Each front gusset panel is also joined to a respective one of the rear gusset panels at the second side edge. Each of the front and rear gusset panels is folded inwardly relative to the front and the rear panel. The top edges of the front panel, rear panel, front gusset panels and rear gusset panels terminate in an upper seam. The bottom edges of the front panel, rear panel, front gusset panels and rear gusset panels terminate in a lower seam. The lower seam is perpendicular to the linear side edges of the front and rear panels.

A U-shaped cut-out is provided. The U-shaped cut-out is located in an upper portion of the bag, and commences at a first point along the upper seam spaced inwardly from the first linear side edge. The cut-out extends to a second point along the upper seam spaced inwardly from the second linear side edge. The cut-out extends downwardly toward the lower seam forming an openable mouth and a pair of bag handles.

In a further variant, the tabs are attached to the openable bag mouth using a cut line, such that as the bag is pulled from the dispenser, the tabs will be torn from the mouth and remain on the hanging means.

In still a further variant, the tabs have a rupturable feature. The rupturable feature connects to the opening and extends toward a perimeter of the tab, whereby when the bag is pulled from the dispenser, the rupturable feature will provide a connection between the opening and the perimeter, permitting the bag to be removed from the hanging means without leaving a portion of the tab on the hanging means.

In yet another variant, the bags include means for removably attaching an upper portion of the rear wall of a first bag to an upper portion of the front wall of a second, adjacent registered bag, whereby when the first bag is pulled from the dispenser, the rear wall will pull the front wall of the second bag forward, causing the second bag to open.

In a farther variant, the means for removably attaching the upper portion of the rear wall of the first bag to the upper portion of the front wall of the second, adjacent registered bag, is selected from the group including glue spotting, corona treatment, hot pinning, cold staking and compression.

In another variant of the invention, the hanging means has an upward facing hook.

In yet another variant, the upward facing hook has a rounded feature at the upper end. The rounded feature is designed to prevent injury and unwanted tearing of the bag tabs.

In a further variant, the positioning bar has a length greater than the first predetermined width.

In still a further variant, the positioning bar has bag control features located at the first and second ends.

In an additional variant, the bag control features include upwardly angled projections. The projections are sized, shaped and positioned to prevent lateral movement of the bags.

In still another variant of the invention, the bag control features have rounded ends. The rounded ends are sized, shaped, and positioned to prevent lateral movement of the bags.

In a further variant, the means for supporting the hanging means also includes a vertically mounted pole. The hanging means project outwardly from the pole.

In still a further variant, the means for supporting the hanging means has a wall mounted bracket. The hanging means projects outwardly from the bracket.

In another variant of the invention, the means for supporting the positioning bar includes an upwardly pointing member. The positioning bar is located perpendicular to and outward from the member.

In yet another variant of the invention, the means for supporting the positioning bar also has a wall mounted bracket. The positioning bar is disposed parallel to and outward from the bracket.

In still another variant, the means for supporting the positioning bar also include a pair of extension brackets. The extension brackets extend from the first and second ends of the positioning bar to the upwardly pointing member. The extension brackets provide sufficient distance between the positioning bar and the upwardly pointing member to locate the positioning bar at the first predetermined distance from the hanging means.

In an additional variant, the extension brackets have means for opening at least one of the brackets to assist in positioning bags over the positioning bar.

In a final variant of the invention, a lower bag end guard is provided. The lower bag end guard has a first end, a second end and a first predetermined height. The lower bag end guard is located parallel to the positioning bar at a level sufficient to prevent access to the lower ends of the bags, whereby when the bags are suspended from the hanging means and located over the positioning bar with the lower ends behind the lower bag end guard, a bag user will not pull the bags from their lower ends and thus be prevented from obtaining more than one bag at a time.

DESCRIPTION OF THE DRAWINGS

FIG. 10 is a perspective view of another alternate embodiment of the dispenser of the invention suitable for wall mounting;

FIG. 11 is a perspective view of another alternate embodiment of the dispenser of the invention suitable for wall mounting having an alternate style of positioning bar;

FIG. 12 is a perspective view of another alternate embodiment of the dispenser of the invention illustrating an opening for more easily positioning the bags on the dispenser; and FIG. 13 is a perspective view of another alternate embodiment of the dispenser of the invention illustrating a lower bag end guard for covering the lower end of the bag pack.

DETAILED DESCRIPTION OF THE PREFERRED EMBODIMENT

Figure 1:
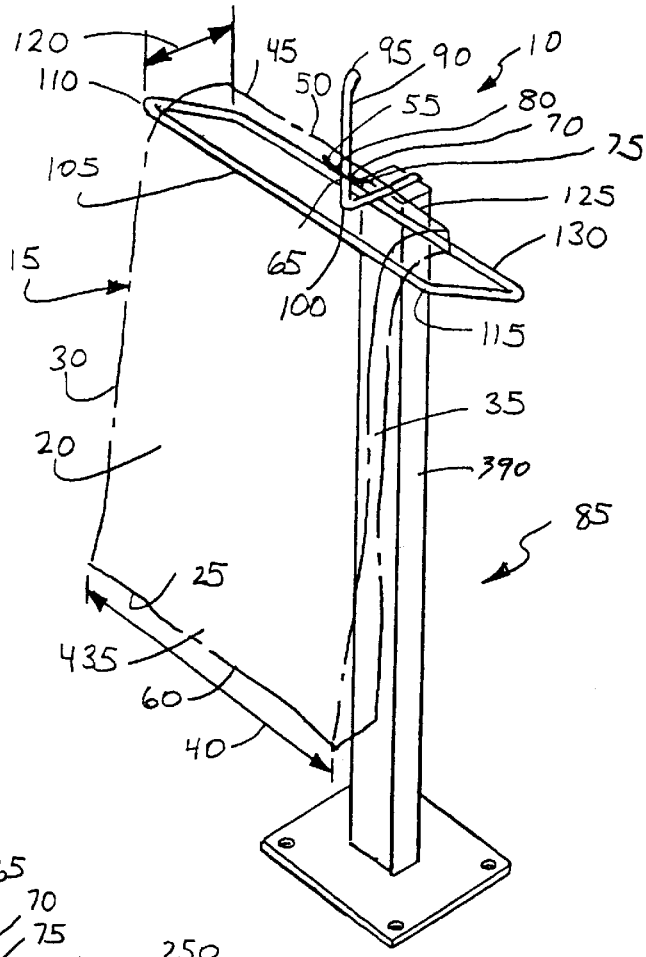
FIG. 1 is a perspective view of the preferred embodiment of the invention illustrating a pack of bags loaded on the dispenser.

FIG. 1 illustrates a bag and dispenser combination 10 providing the desired features that may be constructed from the following components. A plurality of plastic bags 15 is provided. Each of the bags 15 has a front 20 and rear 25 wall, first 30 and second 35 parallel linear side edges, a first predetermined width 40, front 45 and rear 50 top edges, an openable mouth 55, a sealed bottom edge 60, the front 20 and rear 25 walls have front 65 and rear 70 tabs. The tabs 65, 70 are located at the top edges 45, 50 and have an opening 75 therethrough. The opening 75 is sized, shaped and positioned to provide means 80 for hanging the bag 15.

Figure 4:
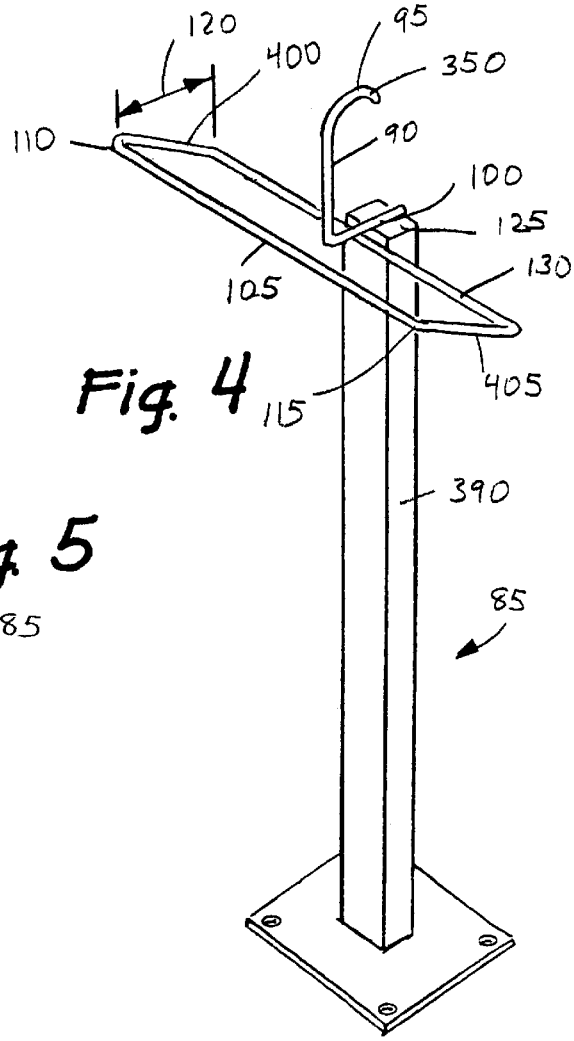
FIG. 4 is a perspective view of an alternate embodiment of the dispenser of the invention illustrating an upward facing hook.
Figure 5:
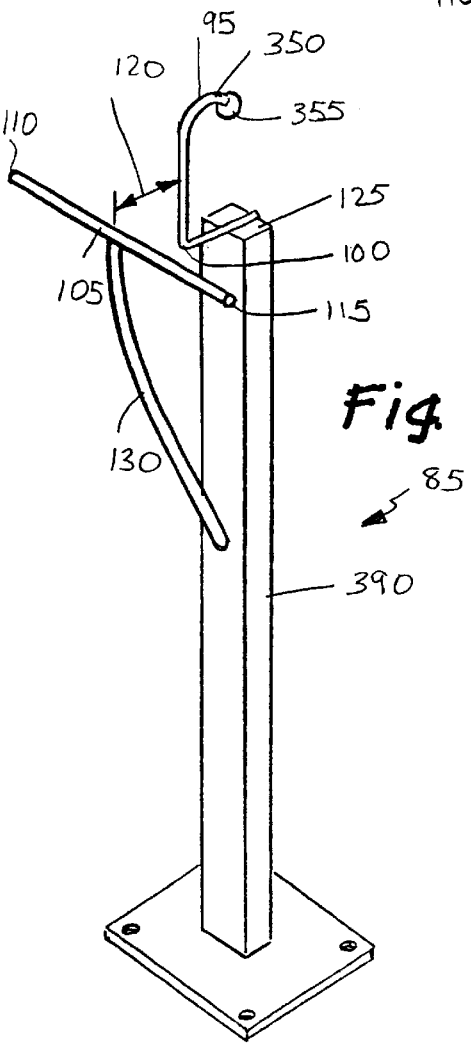
FIG. 5 is a perspective view of another alternate embodiment of the dispenser of the invention illustrating a different style of positioning bar.

As illustrated in FIGS. 1,4 and 5, the dispenser 85 includes the following components. An upward pointing hanging means 90 is provided. The hanging means 90 has upper 95 and lower 100 ends and is sized and shaped to fit slidably through the opening 75 in the tabs 65, 70. A positioning bar 105 is provided. The positioning bar 105 has first 110 and second 115 ends and is positioned horizontally at a first predetermined distance 120 from the hanging means 90. Means 125 for supporting the hanging means 90 are provided, as are means 130 for supporting the positioning bar 105. When the bags 15 are suspended from the hanging means 90 at the tabs 65, 70 and located over the positioning bar 105, the bags 15 will be positioned for individual dispensing.

Figure 2:
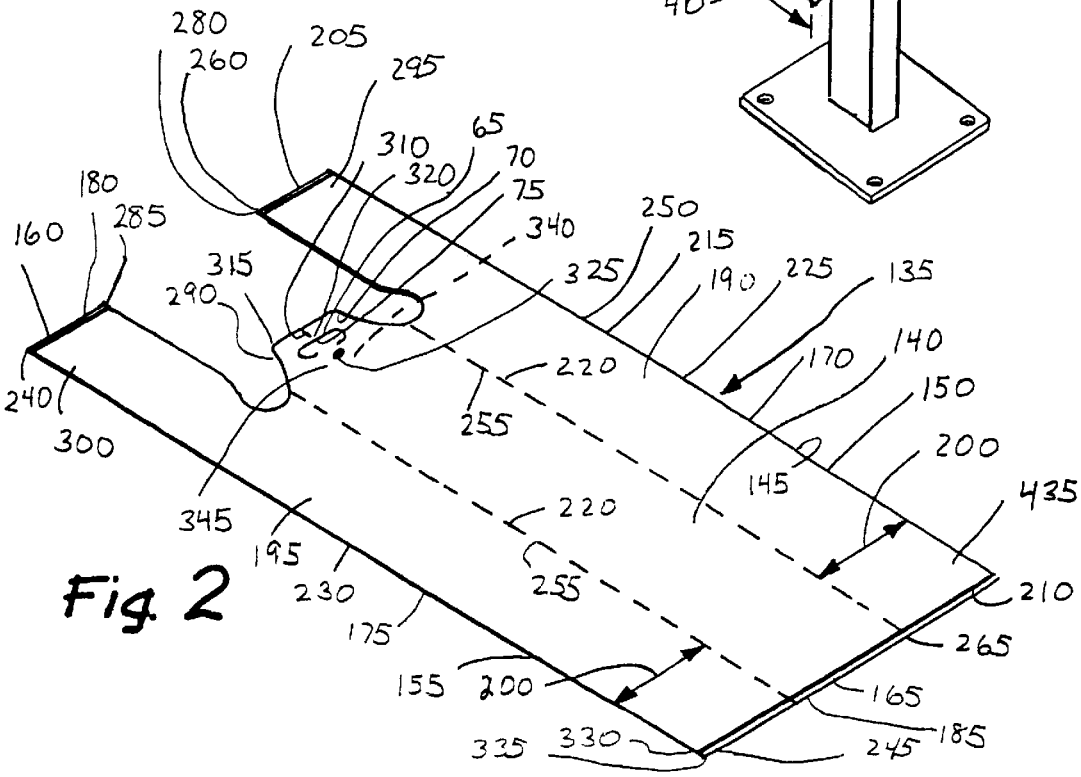
FIG. 2 is a perspective view of a tabless T-shirt style bag suitable for use with the dispenser of the FIG. 1 embodiment illustrating means for attaching the bag walls together.

In a variant of the invention, as illustrated in FIG. 2, the bags 15 are T-shirt style bags 135. Each bag includes a front panel 140 and a rear panel 145. The front panel 140 has first 150 and second 155 parallel linear side edges, a top edge 160 and a bottom edge 165. The rear panel 145 also has first 170 and second 175 parallel linear side edges, a top edge 180 and a bottom edge 185.

Two front gusset panels 190, 195 are provided. The front gusset panels 190, 195 are of a first predetermined dimension 200. Each front gusset panel 190, 195 has a top edge 205, a bottom edge 210, first 215 and second 220 parallel side edges, and is joined at the first side edge 215 to one of the linear side edges 150,155 of the front panel 140. The gusset panels 190, 195 extend from the top edge 160 of the front panel 140 to the bottom edge 165 thereof Two rear gusset panels 225, 230 are provided. The rear gusset panels 225, 230 are of a first predetermined dimension 200. Each rear gusset panel 225, 230 has a top edge 240, a bottom edge 245, first 250 and second 255 parallel side edges, and is joined at the first side edge 250 to one of the linear side edges 170, 175 of the rear panel 145. The gusset panels 225, 230 extend from the top edge 180 of the rear panel 145 to the bottom edge 185 thereof Each front gusset panel 190, 195 is also joined to a respective one of the rear gusset panels 225, 230 at the second side edge 220, 255. Each of the front 190, 195 and rear 225, 230 gusset panels is folded inwardly relative to the front 140 and the rear 145 panel. The top edges 160, 180, 205, 240 of the front panel 140, rear panel 145, front gusset panels 190, 195 and rear gusset panels 225, 230 terminate in an upper seam 260. The bottom edges 165, 185, 210, 245 of the front panel 140, rear panel 145, front gusset panels 190, 195 and rear gusset panels 225, 230 terminate in a lower seam 265. The lower seam 265 is perpendicular to the linear side edges 150, 155, 170, 175 of the front 140 and rear 145 panels.

A U-shaped cut-out 270 is provided. The U-shaped cut-out 270 is located in an upper portion 275 of the bag 135, and commences at a first point 280 along the upper seam 260 spaced inwardly from the first linear side edge 150, 170. The cut-out 270 extends to a second point 285 along the upper seam 260 spaced inwardly from the second linear side edge 155, 175. The cut-out 270 extends downwardly toward the lower seam 265 forming an openable mouth 290 and a pair of bag handles 295, 300.

Figure 3:
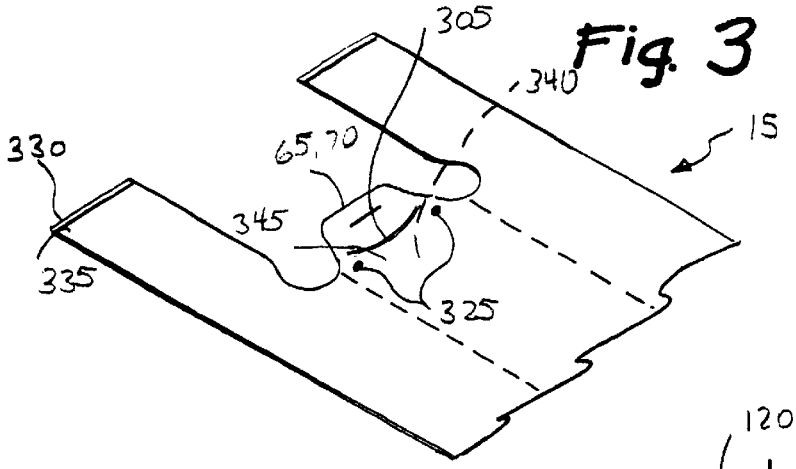
FIG. 3 is a perspective view of a T-shirt style bag with removable tab suitable for use with the dispenser of the FIG. 1 embodiment illustrating means for attaching the bag walls together.

In a further variant, as illustrated in FIG. 3, the tabs 65, 70 are attached to the openable mouth 55 using a cut line 305, such that as the bag 15 is pulled from the dispenser 85, the tabs 65, 70 will be torn from the mouth 55 and remain on the hanging means 90.

In still a further variant, as illustrated in FIG. 2, the tabs 65, 70 have a rupturable feature 310. The rupturable feature 310 connects to the opening 75 and extends toward a perimeter 315 of the tab 65, 70, whereby when the bag 15 is pulled from the dispenser 85, the rupturable feature 310 will provide a connection 320 between the opening 75 and the perimeter 315, permitting the bag 15 to be removed from the hanging means 90 without leaving a portion of the tab 65, 70 on the hanging means 90.

In yet another variant, illustrated in FIGS. 2 and 3, the bags 15 include means 325 for removably attaching an upper portion 340 of the rear wall 25 of a first bag 330 to an upper portion 345 of the front wall 20 of a second, adjacent registered bag 335, whereby when the first bag 330 is pulled from the dispenser 85, the rear wall 25 will pull the front wall 20 of the second bag 335 forward, causing the second bag 335 to open.

In a further variant, the means 325 for removably attaching the upper portion 340 of the rear wall 25 of the first bag 330 to the upper portion 345 of the front wall 20 of the second, adjacent registered bag 335, is selected from the group including glue spotting, corona treatment, hot pinning, cold staking and compression.

In another variant of the invention, as illustrated in FIGS. 4 and 5, the hanging means 90 has an upward facing hook 350.

In yet another variant, illustrated in FIGS. 5, 6, 7, 8 and 9, the upward facing hook 350 has a rounded feature 355 at the upper end 95. The rounded feature 355 is designed to prevent injury and unwanted tearing of the bag tabs 65, 70.

Figure 6:
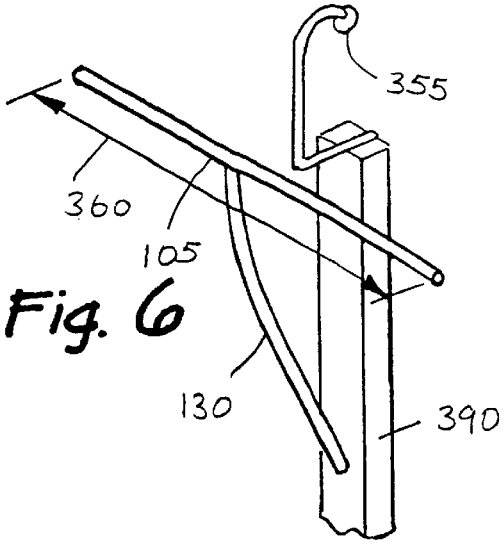
FIG. 6 is a perspective view of another alternate embodiment of the dispenser of the invention illustrating a positioning bar of a predetermined length.
Figure 7:
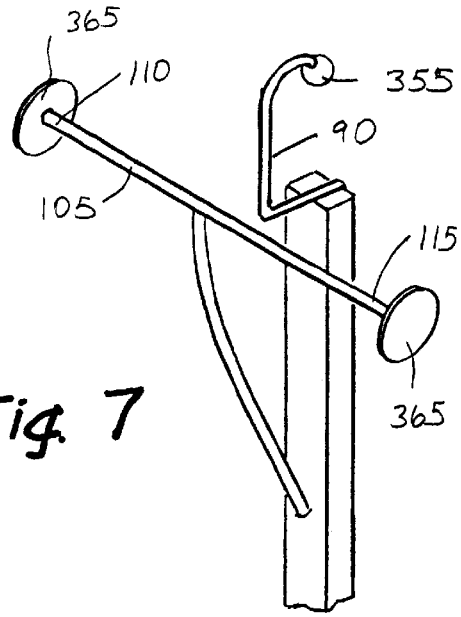
FIG. 7 is a perspective view of another alternate embodiment of the dispenser of the invention illustrating a positioning bar having means at its ends for controlling the movement of bags on the bar.

In a further variant, as illustrated in FIG. 6, the positioning bar 105 has a length 360 greater than the first predetermined width 40.

In still a further variant, as illustrated in FIGS. 7, 8, 9 and 11, the positioning bar 105 has bag control features 365 located at the first 110 and second 115 ends.

Figure 8:
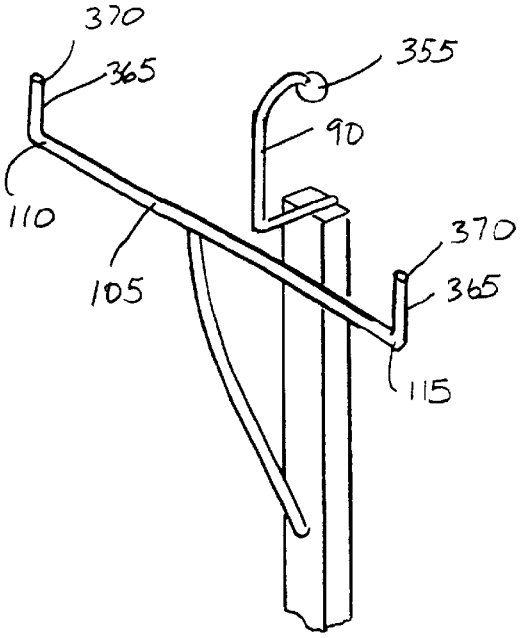
FIG. 8 is a perspective view of another alternate embodiment of the dispenser of the invention illustrating a positioning bar having upward facing ends for controlling the movement of bags on the bar.

In an additional variant, illustrated in FIG. 8, the bag control features 365 include upwardly angled projections 370. The projections 370 are sized, shaped and positioned to prevent lateral movement of the bags 15.

Figure 9:
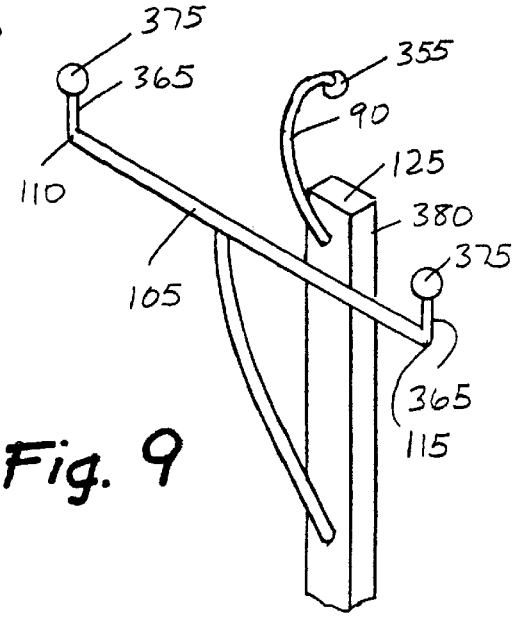
FIG. 9 is a perspective view of another alternate embodiment of the dispenser of the invention illustrating a positioning bar having ball ended upward facing ends for controlling the movement of bags on the bar.

In still another variant of the invention, illustrated in FIG. 9, the bag control features 365 have rounded ends 375. The rounded ends 375 are sized, shaped, and positioned to prevent lateral movement of the bags 15.

In a further variant, as illustrated in FIG. 9, the means 125 for supporting the hanging means 90 also includes a vertically mounted pole 380. The hanging means 90 projects outwardly from the pole 380.

In still a further variant, as illustrated in FIGS. 10 and 11, the means 125 for supporting the hanging means 90 has a wall mounted bracket 385. The hanging means 90 projects outwardly from the bracket 385.

In another variant of the invention, illustrated in FIGS. 4, 5 and 6, the means 130 for supporting the positioning bar 105 includes an upwardly pointing member 390. The positioning bar 105 is located perpendicular to and outward from the member 390.

In yet another variant of the invention, illustrated in FIGS. 10 and 11 the means 130 for supporting the positioning bar 105 is a wall mounted bracket 385. The positioning bar 105 is disposed parallel to and outward from the bracket 385.

In still another variant, as illustrated in FIG. 13, the means 130 for supporting the positioning bar 105 also include a pair of extension brackets 400, 405. The extension brackets 400, 405 extend from the first 110 and second 115 ends of the positioning bar 105 to the upwardly pointing member 390. The extension brackets 400, 405 provide sufficient distance between the positioning bar 105 and the upwardly pointing member 390 to locate the positioning bar 105 at the first predetermined distance 120 from the hanging means 90.

In an additional variant, illustrated in FIG. 12, the extension brackets 400, 405 have means 410 for opening at least one of the brackets 400, 405 to assist in positioning bags 15 over the positioning bar 105.

In a final variant of the invention, illustrated in FIG. 13, a lower bag end guard 415 is provided. The lower bag end guard 415 has a first end 420, a second end 425 and a first predetermined height 430. The lower bag end guard 415 is located parallel to the positioning bar 105 at a level sufficient to prevent access to lower ends 435 of the bags 15. When the bags 15 are suspended from the hanging means 90 and located over the positioning bar 105 with the lower ends 435 behind the lower bag end guard 415, a bag user will not pull the bags 15 from their lower ends 435 and thus be prevented from obtaining more than one bag 15 at a time.

What is claimed is:

1. A bag and dispenser combination, comprising:

a plurality of plastic bags, each of said bags having a front wall, a back wall, first and second parallel linear side edges, a first predetermined width, front and rear top edges, an openable mouth, a sealed bottom edge, said front and rear walls having front and rear tabs;

said tabs being disposed at said top edges and having an opening therethrough, said opening being sized, shaped and disposed to provide means for hanging the bag;

a dispenser, said dispenser comprising:

an upward pointing hanging means, said hanging means having upper and lower ends and being sized and shaped to fit slidably through said opening in said tabs;

a positioning bar, said positioning bar having first and second ends and being disposed horizontally at a first predetermined distance from said hanging means;

said first predetermined distance being a distance sufficient to locate said positioning bar against said back wall below said openable mouth of a last bag of said plurality of bags disposed upon said dispenser;

means for supporting said hanging means;

means for supporting said positioning bar; and whereby, when the plurality of bags are suspended from said hanging means at said tabs and disposed over said positioning bar, said bags will be positioned for individual dispensing.

2. The bag and dispenser combination as described in claim 1, wherein each of the bags is a T-shirt style bag comprising:

a front panel, said front panel having first and second parallel linear side edges, a top edge and a bottom edge;

a rear panel said rear panel having first and second parallel linear side edges, a top edge and a bottom edge;

two front gusset panels of a first predetermined dimension, each front gusset panel having a top edge, a bottom edge, first and second parallel side edges and being joined at said first side edge to one of the linear side edges of the front panel and extending from the top edge of the front panel to the bottom edge thereof;

two rear gusset panels of the first predetermined dimension, each rear gusset panel having a top edge, a bottom edge, first and second parallel side edges and being joined at said first side edge to one of the linear side edges of the rear panel and extending from the top edge of the <u>rear</u> panel to the bottom edge thereof;

each front gusset panel also being joined to a respective one of said rear gusset panels at said second side edge;

each of the front and rear gusset panels being folded inwardly relative to the front and the rear panel;

the top edges of the front panel, the rear panel, the front gusset panels and the rear gusset panels terminating in an upper seam;

the bottom edges of the front panel, the rear panel, the front gusset panels and the rear gusset panels terminating in a lower seam, said lower seam being perpendicular to the linear side edges of the front and rear panels; and a U-shaped cut-out, said U-shaped cut-out being disposed in an upper portion of the bag and commencing at a first point along the upper seam spaced inwardly from said first linear side edge and extending to a second point along the upper seam spaced inwardly from said second linear side edge, said cut-out extending downwardly toward the lower seam, thereby forming an openable mouth and a pair of bag handles.

3. The bag and dispenser combination as described in claim 1, wherein said tabs are attached to said openable mouth using a cut line such that as the bag is pulled from the dispenser, the tabs will be torn from the bag mouth and remain on the hanging means.

4. The bag and dispenser combination as described in claim 1, wherein said tabs further comprise:

a rupturable feature, said rupturable feature connecting to said opening and extending toward a perimeter of said tab; and whereby, when the bag is pulled from the dispenser, the rupturable feature will provide a connection between the opening and the perimeter, permitting the bag to be removed from the hanging means without leaving a portion of the tabs on the hanging means.

5. The bag and dispenser combination as described in claim 1, wherein said bags further comprise:

means for removably attaching an upper portion of said rear wall of a first bag to an upper portion of said front wall of a second, adjacent registered bag; and whereby, when said first bag is pulled from said dispenser, said rear wall will pull said front wall of said second bag forward, causing said second bag to open.

6. The bag and dispenser combination as described in claim 5, wherein said means for removably attaching said upper portion of said rear wall of the first bag to said upper portion of said front wall of the second, adjacent registered bag is selected from the group comprising:

glue spotting, corona treatment, hot pinning, cold staking and compression.

7. The bag and dispenser combination as described in claim 1, wherein said hanging means comprises an upward facing hook.

8. The bag and dispenser combination as described in claim 7, wherein said upward facing hook further comprises a rounded feature at said upper end, said rounded feature designed to prevent injury and unwanted tearing of the bag tabs.

9. The bag and dispenser combination as described in claim 1, wherein said positioning bar has a length greater than said first predetermined width.

10. The bag and dispenser combination as described in claim 1, wherein said positioning bar has bag control features disposed at said first and second ends.

11. The bag and dispenser combination as described in claim 10, wherein said bag control features comprise upwardly angled projections, said projections being sized, shaped and disposed to prevent lateral movement of the bags.

12. A bag and dispenser combination as described in claim 10, wherein said bag control features comprise rounded ends, said rounded ends being sized, shaped and disposed to prevent lateral movement of the bags.

13. The bag and dispenser combination as described in claim 1, wherein said means for supporting said hanging means further comprises a vertically mounted pole, said hanging means projecting outwardly from said pole.

14. A bag and dispenser combination as described in claim 1, wherein said means for supporting said hanging means further comprises a wall mounted bracket, said hanging means projecting outwardly from said bracket.

15. The bag and dispenser combination as described in claim 1, wherein said means for supporting said positioning bar comprises a upwardly pointing member, said positioning bar being disposed perpendicular to and outward from said member.

16. The bag and dispenser combination as described in claim 15, wherein said means for supporting said positioning bar further comprises:

a pair of extension brackets, said extension brackets extending from said first and second ends of said positioning bar to said upwardly pointing member;

said extension brackets providing sufficient distance between said positioning bar and said upwardly pointing member to dispose said position bar at said first predetermined distance from said hanging means.

17. A bag and dispenser combination as described in claim 16, wherein said extension brackets further comprise means for opening at least one of said brackets to assist in positioning bags over said positioning bar.

18. A bag and dispenser combination as described in claim 1, wherein said means for supporting said positioning bar further comprises a wall mounted bracket, said positioning bar being disposed parallel to and outward from said bracket.

19. A bag and dispenser combination as described in claim 1, further comprising:

a lower bag end guard, said lower bag end guard having a first end, a second end and a first predetermined height;

said lower bag end guard being disposed parallel to said positioning bar at a level sufficient to prevent access to lower ends of said bags; and whereby, when said bags are suspended from said hanging means and disposed over said positioning bar with said lower ends behind said lower bag end guard, a bag user will not pull the bags from their lower ends and thus be prevented from obtaining more than one bag at a time.

* * * * *